US007004263B2

(12) United States Patent
Moriarty et al.

(10) Patent No.: US 7,004,263 B2
(45) Date of Patent: Feb. 28, 2006

(54) DIRECTIONAL CASING DRILLING

(75) Inventors: Keith A. Moriarty, Houston, TX (US); Michael R. Johnson, Sugar Land, TX (US); Attilio C. Pisoni, Houston, TX (US); Ruben Martinez, Houston, TX (US); Spyro Kotsonis, Robinson (FR); Alain P. Dorel, Caluire-et-Cuire (GF); Pat Patterson, Beasley, TX (US); Stuart Schaaf, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 194 days.

(21) Appl. No.: 10/605,496

(22) Filed: Oct. 2, 2003

(65) Prior Publication Data

US 2004/0104051 A1 Jun. 3, 2004

Related U.S. Application Data

(63) Continuation-in-part of application No. 10/140,192, filed on May 6, 2002, now Pat. No. 6,840,336, and a continuation-in-part of application No. 10/122,108, filed on Apr. 12, 2002.

(60) Provisional application No. 60/296,020, filed on Jun. 5, 2001, provisional application No. 60/289,771, filed on May 9, 2001.

(51) Int. Cl.
*E21B 7/04* (2006.01)

(52) U.S. Cl. ..... 175/27; 175/61; 175/76

(58) Field of Classification Search ..... 175/27, 175/61, 62, 73, 76
See application file for complete search history.

(56) References Cited

U.S. PATENT DOCUMENTS

| | | | | |
|---|---|---|---|---|
| 4,635,736 | A * | 1/1987 | Shirley | 175/76 |
| 4,842,081 | A | 6/1989 | Parant | |
| 5,082,069 | A | 1/1992 | Seiler et al. | |
| 5,117,927 | A | 6/1992 | Askew | |
| 5,197,553 | A | 3/1993 | Leturno | |
| 5,219,028 | A | 6/1993 | Martin et al. | |
| 5,255,741 | A | 10/1993 | Alexander | |
| 5,452,967 | A | 9/1995 | Fuller | |
| 5,456,326 | A | 10/1995 | Raines | |
| 5,472,057 | A | 12/1995 | Winfree | |
| 5,662,170 | A | 9/1997 | Donovan et al. | |
| 5,755,289 | A | 5/1998 | Angman et al. | |
| 5,839,519 | A | 11/1998 | Spedale, Jr. | |
| 5,845,722 | A | 12/1998 | Makohl et al. | |
| 5,921,332 | A | 7/1999 | Spedale, Jr. | |
| 5,950,742 | A | 9/1999 | Caraway | |
| 5,957,225 | A | 9/1999 | Sinor | |
| 6,102,119 | A | 8/2000 | Raines | |

(Continued)

FOREIGN PATENT DOCUMENTS

EP 0462618 A2 12/1991

(Continued)

*Primary Examiner*—William Neuder
(74) *Attorney, Agent, or Firm*—Jennie Salazar; Victor H. Segura; Dale V. Gaudier

(57) ABSTRACT

A directional casing drilling system including a casing string for rotation of a drill bit, a shaft coupled to the casing string, and a sleeve having pads that are hydraulically extensible. The sleeve may be positioned about a portion of the shaft. The invention may also include a tube connecting the sleeve to the drill collar, the tube adapted to conduct drilling fluid, and a valve system adapted to operatively conduct at least a portion of the drilling fluid to the pads whereby the pads move between an extended position and a retracted position.

23 Claims, 14 Drawing Sheets

U.S. PATENT DOCUMENTS

| | | | | |
|---|---|---|---|---|
| 6,158,531 | A | 12/2000 | Vail, III | |
| 6,182,776 | B1 | 2/2001 | Asberg | |
| 6,196,336 | B1 | 3/2001 | Fincher et al. | |
| 6,199,641 | B1 | 3/2001 | Downie et al. | |
| 6,227,306 | B1 | 5/2001 | Downie et al. | |
| 6,263,987 | B1 | 7/2001 | Vail, III | |
| 6,311,792 | B1 | 11/2001 | Scott et al. | |
| 6,595,303 | B1 * | 7/2003 | Noe et al. | 175/74 |
| 6,840,336 | B1 * | 1/2005 | Schaaf et al. | 175/27 |
| 2001/0011591 | A1 * | 8/2001 | Van-Drentham Susman et al. | 166/298 |
| 2002/0040787 | A1 | 4/2002 | Cook et al. | |
| 2002/0050360 | A1 | 5/2002 | Cook et al. | |
| 2002/0175003 | A1 | 11/2002 | Pisoni et al. | |
| 2002/0179336 | A1 | 12/2002 | Schaaf et al. | |
| 2004/0140128 | A1 * | 7/2004 | Vail, III | 175/57 |

FOREIGN PATENT DOCUMENTS

| | | | |
|---|---|---|---|
| WO | WO00/37771 | | 6/2000 |
| WO | WO00/50730 | | 8/2000 |
| WO | WO01/83932 | A1 | 11/2001 |
| WO | WO01/86111 | A1 | 11/2001 |
| WO | WO01/94738 | A1 | 12/2001 |
| WO | WO01/94739 | A1 | 12/2001 |
| WO | WO02/10549 | A2 | 2/2002 |
| WO | WO02/14649 | A1 | 2/2002 |

* cited by examiner

DIRECTIONAL CASING DRILLING

CROSS REFERENCE TO RELATED APPLICATIONS

This application is a continuation-in-part of U.S. patent application Ser. No. 10/140,192 filed on May 6, 2002 now U.S. Pat. No. 6,840,336, which claims priority pursuant to U.S. Provisional Application No. 60/296,020 filed on Jun. 5, 2001, and U.S. patent application Ser. No. 10/122,108 filed on Apr. 12, 2002, which claims priority pursuant to U.S. Provisional Application No. 60/289,771 filed on May 9, 2001.

BACKGROUND OF INVENTION

Wells are generally drilled into the ground to recover natural deposits of hydrocarbons and other desirable materials trapped in geological formations in the Earth's crust. A well is typically drilled by advancing a drill bit into the earth. The drill bit is attached to the lower end of a "drill string" suspended from a drilling rig. The drill string is a long string of sections of drill pipe that are connected together end-to-end to form a long shaft for driving the drill bit further into the earth. A bottom hole assembly (BHA) containing various instrumentation and/or mechanisms is typically provided above the drill bit. Drilling fluid, or mud, is typically pumped down through the drill string to the drill bit. The drilling fluid lubricates and cools the drill bit, and it carries drill cuttings back to the surface in the annulus between the drill string and the borehole wall.

In conventional drilling, a well is drilled to a selected depth, and then the wellbore is typically lined with a larger-diameter pipe, usually called casing. Casing typically consists of casing sections connected end-to-end, similar to the way drill pipe is connected. To accomplish this, the drill string and the drill bit are removed from the borehole in a process called "tripping." Once the drill string and bit are removed, the casing is lowered into the well and cemented in place. The casing protects the well from collapse and isolates the subterranean formations from each other. After the casing is in place, drilling may continue.

Conventional drilling typically includes a series of drilling, tripping, casing and cementing, and then drilling again to deepen the borehole. This process is very time consuming and costly. Additionally, other problems are often encountered when tripping the drill string. For example, the drill string may get caught up in the borehole while it is being removed. These problems require additional time and expense to correct.

The term "casing drilling" refers to the use of a casing string in place of a drill string. Like drill string, a chain of casing sections are connected end-to-end to form a casing string. The BHA and the drill bit are connected to the lower end of a casing string, and the well is drilled using the casing string to transmit drilling fluid, as well as axial and rotational forces, to the drill bit. Upon completion of drilling, the casing string may then be cemented in place to form the casing for the wellbore. Casing drilling enables the well to be simultaneously drilled and cased.

FIG. 1 shows a prior art casing drilling operation. A drilling rig 100 at the surface is used to rotate a casing string 110, or drill string comprised of casing. The casing string 110 extends down into borehole 102. A BHA 111 is connected at the lower end of the casing string 110. A drill bit 114 and an underreamer 112 are also provided at the lower end of the BHA 111.

When using casing drilling, the drill bit 114, underreamer 112, and the BHA 111 are typically sized so that they may be retrieved up through string 110 when drilling has been completed or when replacement and maintenance of the drill bit 114 is required. The drill bit 114 drills a pilot hole 104 that is enlarged by an underreamer 112 so that the casing string 110 will fit into the drilled hole 102. A typical underreamer 112 can be positioned in an extended and a retracted position. In the extended position, the underreamer 112 is able to enlarge the pilot hole 104 to a size larger than the casing string 110, so that the casing string will be able to fit into the drilled wellbore. In the retracted position (not shown), the underreamer 112 is retracted so that is able to travel through the inside of the casing string 110.

Casing drilling eliminates the need to trip the drill string before the well is cased. The BHA may simply be retrieved by pulling it up through the casing string. The casing string may then be cemented in place, and then drilling may continue. This reduces the time required to retrieve the BHA and eliminates the need to subsequently run casing into the well.

Another aspect of drilling is called "directional drilling." Directional drilling is the intentional deviation of the wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

One method of directional drilling uses a BHA that includes a bent housing and a mud motor. A bent housing apparatus is described in U.S. Pat. No. 5,117,927, which is assigned to the assignee of the present invention. That patent is incorporated by reference in its entirety. An example of a bent housing 200 is shown in FIG. 2A. The bent housing 200 includes an upper section 203 and a lower section 204 that are formed on the same drill pipe, but are separated by a bend 201. The bend 201 is a permanent bend in the pipe.

With a bent housing 200, the drill string is often not rotated from the surface. Instead, the drill bit 205 is pointed in the desired drilling direction, and the drill bit 205 is rotated by a mud motor (not shown) in the BHA. A mud motor converts some of the energy of the mud flowing down through the drill pipe into a rotational motion that drives the drill bit 205. Thus, by maintaining the bent housing 200 at the same azimuthal position with respect to the borehole, the drill bit 205 will drill in the desired direction.

When straight drilling is desired, the drill string, including the bent housing 200, is rotated from the surface. The drill bit 205 angulates with the bent housing 200 and drills a slightly overbore, but straight, borehole (not shown).

Another method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling.

Generally, there are two types of RSS's point the bit systems and push the bit systems. In a point the bit system, the drill bit is pointed in the desired direction of the borehole deviation, similar to a bent housing. Embodiments of a point the bit type system are described in U.S. patent application Ser. No. 10/122,108, published on Nov. 28, 2002, as Publication No. 2002/0175003. That application is assigned to the assignee of the present invention, and it is incorporated by reference in its entirety. A point the bit system works in a similar manner to a bent housing because a point the bit system typically includes a mechanism for providing a drill bit alignment that is different from the drill string axis. The primary differences are that a bent housing has a permanent bend at a fixed angle, and a point the bit RSS has an adjustable bend angle that is controlled independent of the rotation from the surface.

FIG. 2B shows a point the bit system 210. A point the bit RSS 210 typically has an drill collar 213 and a drill bit shaft 214. The drill collar includes an internal orientating and control mechanism that counter-rotates relative to the drill string. This internal mechanism controls the angular orientation of the drill bit shaft 215 relative to the borehole.

The angle θ between the drill bit shaft 215 and the drill collar 213 may be selectively controlled. The angle θ shown in FIG. 2B is exaggerated for purposes of illustration. A typical angle is less than 2 degrees.

The "counter rotating" mechanism rotates in the opposite direction of the drill string rotation. Typically, the counter rotation is at the same speed of the drill string rotation so that the counter rotating section maintains the same angular position relative to the inside of the borehole. Because the counter rotating section does not rotate with respect to the borehole, it is often called "geo-stationary" by those skilled in the art. In this disclosure, no distinction is made between the terms "counter rotating" and "geo-stationary."

In a push the bit system, devices on the BHA push the drill bit laterally in the direction of the desired borehole deviation by pressing on the borehole wall. Embodiments of a push the bit type system are described in U.S. patent application Ser. No. 10/140,192, published on Dec. 5, 2002, as Publication No. 2002/0179336. That application is assigned to the assignee of the present invention, and it is incorporated by reference in its entirety.

A push the bit system typically uses either a rotating or non-rotating stabilizer and pad assembly stabilizer. When the borehole is to be deviated, a actuator presses a pad against the borehole wall in the opposite direction from the desired deviation. The result is that the drill bit is pushed in the desired direction.

FIG. 2C shows a typical push the bit system 220. The drill string 223 includes a collar 221 that includes a plurality of extendable and retractable pads 226. Because the pads 226 are disposed in the non-rotating collar 221, they do not rotate with respect to the borehole (not shown). When a pad 226 is extended into contact with the borehole (not shown) during drilling, the drill bit 225 is pushed in the opposite direction, enabling the drilling of a deviated borehole.

What is needed is a technique which captures the benefits of various RSS's for use in casing drilling applications. It is desirable that such a technique would permit drilling and casing with the same tool, while permitting directional drilling. It is further desirable that such a system employ downhole drilling tools capable of drilling to optimize the casing operation as well as the drilling operation. The present invention is provided to meet these and other needs.

SUMMARY OF INVENTION

In certain embodiments, the invention in related to a directional casing drilling system including a casing string for rotation of a drill bit, a shaft coupled to the casing string, and a sleeve having pads hydraulically extensible therefrom. The sleeve may be positioned about a portion of the shaft. The invention may also include a tube connecting the sleeve to the drill collar, the tube adapted to conduct drilling fluid therethrough, and a valve system adapted to operatively conduct at least a portion of the drilling fluid to the pads whereby the pads move between an extended position and a retracted position.

In some embodiments, the invention relates to a method of drilling a wellbore. The method includes positioning a drilling tool connected to the end of a casing string in a wellbore the drilling tool having a bit and a sleeve with extendable pads therein, passing a fluid through the tool, and diverting at least a portion of the fluid to the sleeve for selective extension of the pads whereby the tool drills in a desired direction.

In some embodiments the invention relates to a rotary steerable casing drilling system, that includes a casing string for rotation of the drill bit and a tool collar comprising an interior, an upper end and a lower end. The upper end of the tool collar operatively coupled to the casing string. The invention may also include a bit shaft having an exterior surface, an upper end and a lower end, the bit shaft being supported within the tool collar for pivotal movement about a fixed position along the bit shaft. The invention may also include a variable bit shaft angulating mechanism, located within the interior of the tool collar, comprising a motor, an offset mandrel having an upper end and a lower end, and a variable offset coupling, having an upper end and a lower end, the motor attached to the upper end of the offset mandrel and adapted to rotate the offset mandrel, the upper end of variable offset coupling being uncoupleably attached to an offset location of the lower end of the offset mandrel, and the upper end of the bit shaft being rotatably coupled to the variable offset coupling. The invention may also include a torque transmitting coupling adapted to transmit torque from the tool collar to the bit shaft at the fixed position along the bit shaft, and a seal system adapted to seal between the lower end of the collar and the bit shaft.

In certain embodiments, the invention relates to a rotary steerable casing drilling system including a casing string for rotation of the drill bit and a control unit disposed in a drill collar. The control unit includes an instrument carrier, a first impeller coupled to the instrument carrier, and a second impeller coupled to the instrument carrier. The rotary steerable system may also include a pad section having at least one pad hydraulically extensible therefrom, a valve system operatively coupled to the control unit and adapted to selectively conduct at least a portion of a drilling fluid to the pads whereby the at least one pad moves between an extended position and a retracted position, wherein the control unit remains in a geo-stationary position and operates the valve system to modulate a fluid pressure supplied to the pad section in synchronism with rotation of the casing string so that each of the at least one pad is extended at the same rotational position so as to bias the drill bit in a selected direction.

DETAILED DESCRIPTION

In some embodiments, the invention is related to a casing drilling system with a rotary steerable system. In some embodiments, a rotary steerable system is a push the bit system. In other embodiments, a rotary steerable system is a point the bit system. Certain embodiments of the invention will now be described with reference to the figures.

Figure 3:
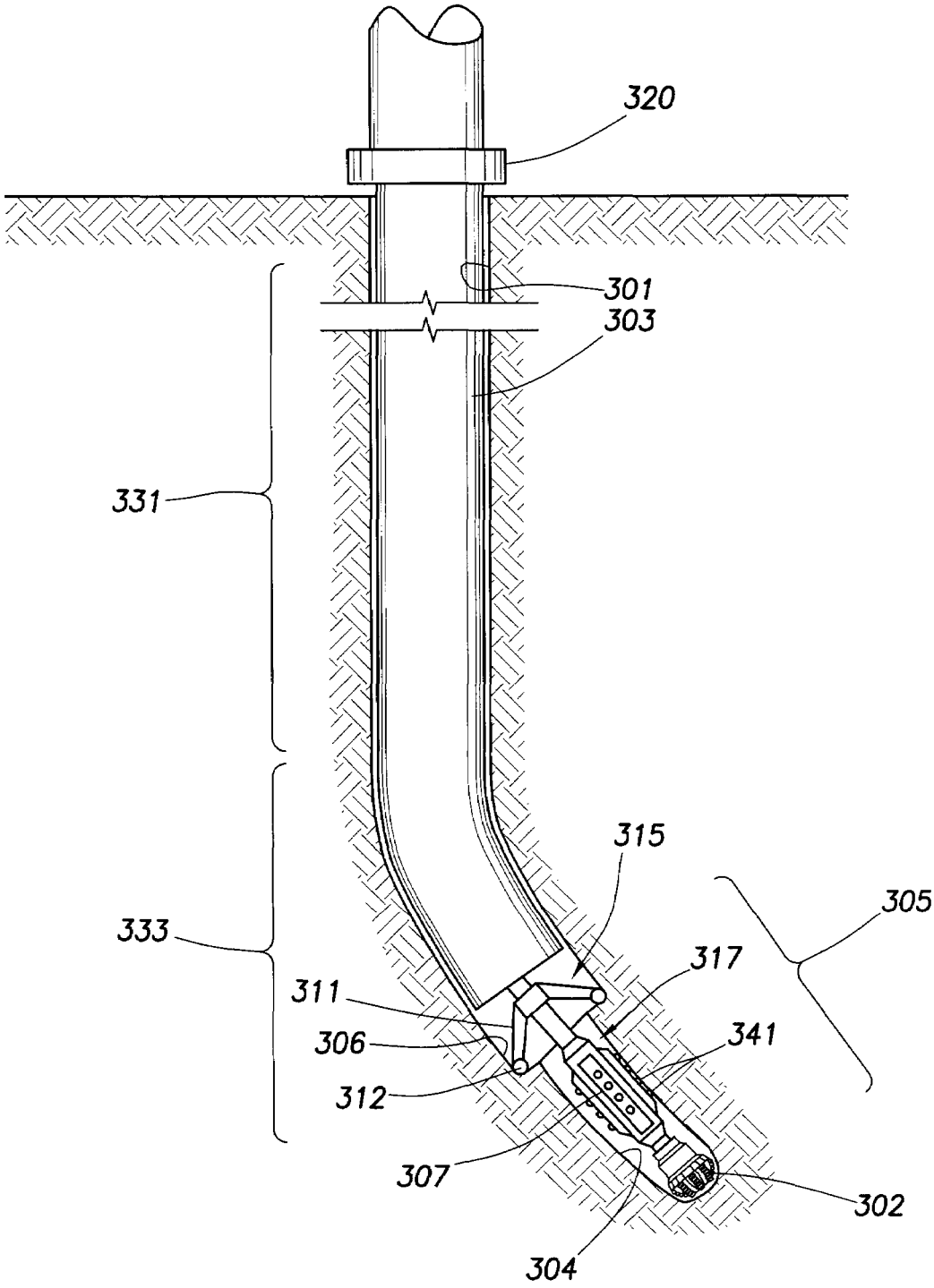
FIG. 3 shows a casing drilling application with a push the bit RSS according to one embodiment of the invention.

FIG. 3 shows a wellbore 301 that is directionally drilled using a bottom hole assembly 305 ("BHA") that includes a rotary steerable system 317 ("RSS"). The BHA 305 is positioned at the bottom of a drill string formed by casing string 303. The casing string 303 is made of multiple casing joints connected end-to-end. The casing string 303 extends upwardly to the surface where it is driven by a rotary table 320 or preferably a top drive of a typical drilling rig (not shown). The well bore is shown as having a vertical or substantially vertical upper portion 331 and a curved lower portion 333. It will be appreciated that the wellbore 301 may be of any direction or dimension for the purposes herein.

The RSS 317 includes a non-rotating sleeve 307 that is preferably surrounded by extendable and/or retractable pads 341 in order to, for example, stabilize the drill string at a specific position within the well's cross section, or for changing the direction of the drill bit 302. The pads 341 are preferably actuated (i.e., extended or retracted) by the drilling fluid passing through the RSS 317 as will be described more fully herein.

The drill bit 302 drills what is called a "pilot hole" 304. The drill bit 302 is sized to be smaller than the casing string 303 so that it can be moved through the casing string 303. Thus, the pilot hole 304 drilled by the drill bit 302 is not large enough for the casing string 303 to pass through. An underreamer 315 is disposed in the BHA 305 and below the casing string 303. The underreamer 315 includes arms 311 that can be positioned in a retracted or an extended position. In the retracted position (not shown), the underreamer 315 may pass through the casing string 303. In the extended position, the underreamer 315 has a diameter slightly larger than the casing string 303. Cutters 312 on the end of the arms 311 of the underreamer 315 enlarge the size of the pilot hole 304 to the full borehole size 306 so that the casing string 303 can pass through.

The underreamer 315 enables the BHA 305 to drill a borehole of sufficient size for the casing string 303 to pass, while still enabling the BHA to be removed from the well by pulling it up through the casing string 303 when the underreamer 315 is in the retracted position (not shown).

An underreamer is a tool used to enlarge the pilot hole drilled by the bit. Those having skill in the art will realize that other types of tools could be used to enlarge the borehole without departing from the scope of the invention.

Figure 4:
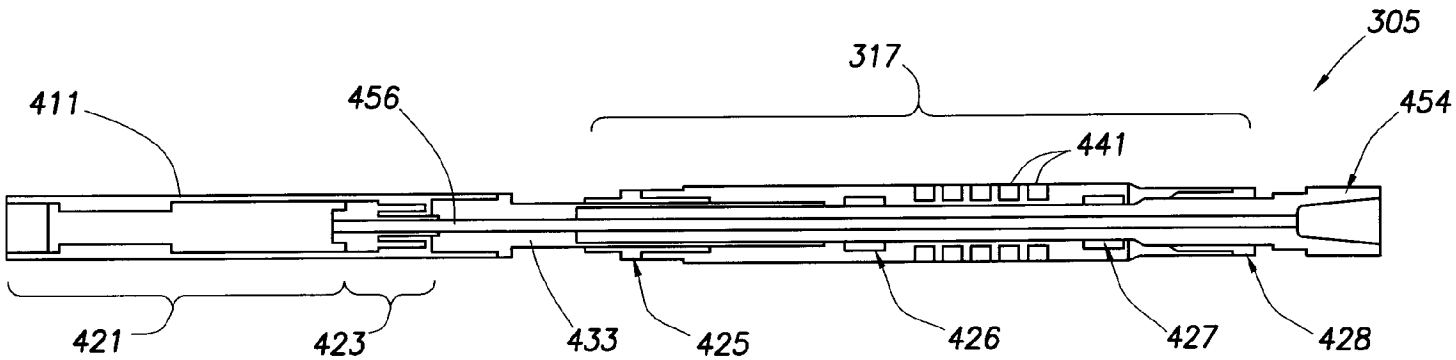
FIG. 4 shows a cross-section of a part of a BHA according to one embodiment of the invention.

The portion of the BHA 305 containing the RSS 317 is shown in greater detail in FIG. 4. The RSS 317 includes at least four main sections: a control and sensing section 421, a valve section 423, non-rotating sleeve section (RSS 317) surrounding a central shaft 454, and a flexible shaft 433 connecting the sleeve section (RSS 317) to the rotating drill collar 411. A central passage 456 extends through the RSS 317.

Figure 5:
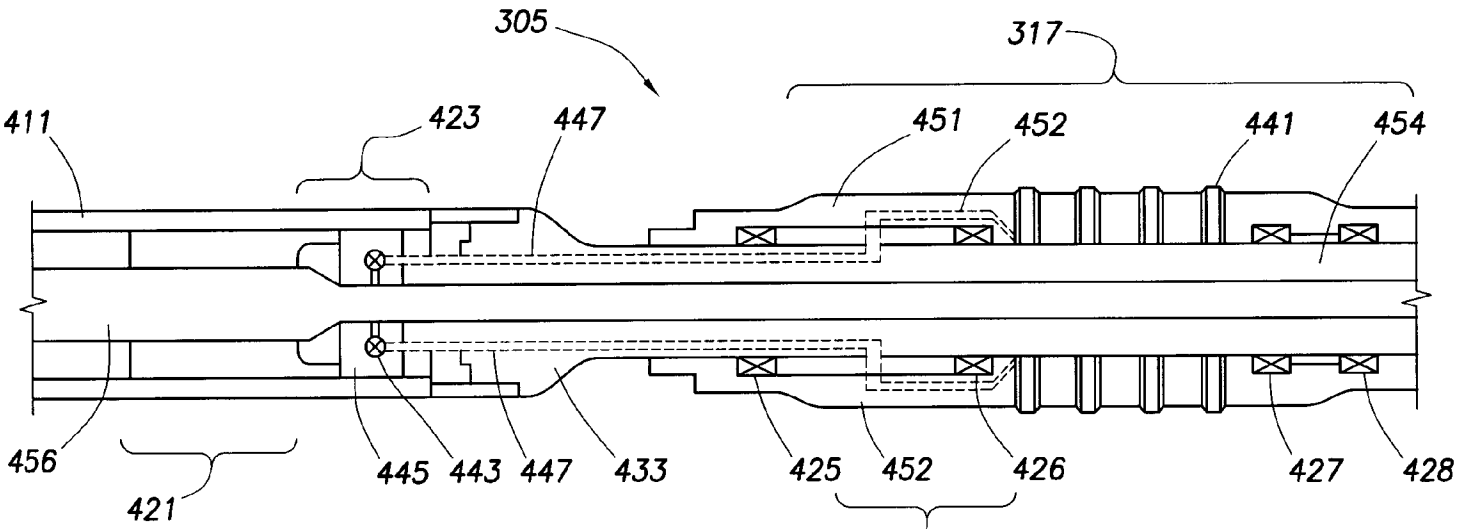
FIG. 5 shows a cross-section of a part of a BHA according to one embodiment of the invention.

A more detailed view of the RSS 317 is shown in FIG. 5. The control and sensing section 421 is positioned within the drill collar 411 and includes sensors (not shown) to, among other things, detect the angular position of the sleeve section (RSS 317) and/or the position of the valve section 423 within the tool. Position information may be used in order to, for example, determine which pad 441 to actuate.

The control and sensing section 421 preferably includes sensors (not shown) to determine the position of the non-rotating sleeve (RSS 317) with respect to gravity and the position of the valve assembly 423 to determine which pads are activated. Additional electronics may be included, such as acquisition electronics, tool face sensors, and electronics to communicate with measurement while drilling tools and/or other electronics. A tool face sensor package may be utilized to determine the tool face of the rotating assembly and compensate for drift. The complexity of these electronics can vary from a single accelerometer to a full D&I package (i.e., three or more accelerometers and/or three or more magnetometers) or more. The determination of the complexity is dependent on the application and final operation specifications of the system. The complexity of the control and sensing section 421 may also be determined by the choice of activation mechanism and the operational requirements for control, such as those discussed more fully herein.

The sleeve section (RSS 317), central shaft 454 and the drill collar 411 may preferably be united by a flexible shaft 433. Alternate devices for uniting these components may also be used. This enables the axis of the rotating drill collar 411 and the rotating central shaft 454 to move independently as desired. The flexible shaft 433 extends from the rotating drill collar 411 to the non-rotating sleeve (RSS 317) to improve control. The non-rotating sleeve section (RSS 317) includes a sleeve body 451 with a number of straight blades 452, bearing sections 425, 426, 427, 428 and pads 441. The non-rotating sleeve section (RSS 317) rests on bearing sections 425, 426, 427, 428 of the RSS 317, and allows axial forces to be transmitted through the non-rotating sleeve section (RSS 317) to the rotating central shaft 454 while the non-rotating sleeve slides within the wellbore as the tool advances or retracts.

The valve section 423 operates as an activation mechanism for independent control of the pads 441. The mechanism is comprised of a valve system 443, a radial face seal assembly (not shown), an activation mechanism 445 and hydraulic conduits 447. Drilling fluid is distributed to the pistons 453 through the hydraulic conduits 447 that extend from the valve section 423 to distribution system 429 and to the pistons 453 (not shown in FIG. 5). The valve section 423 can provide continuous and/or selective drilling fluid to conduit(s) 447. The valve section preferably incorporates an activation mechanism 445 to allow for independent control of a number of blades. Various activation mechanisms usable in connection with the RSS 317 will be described further herein.

Figure 6:
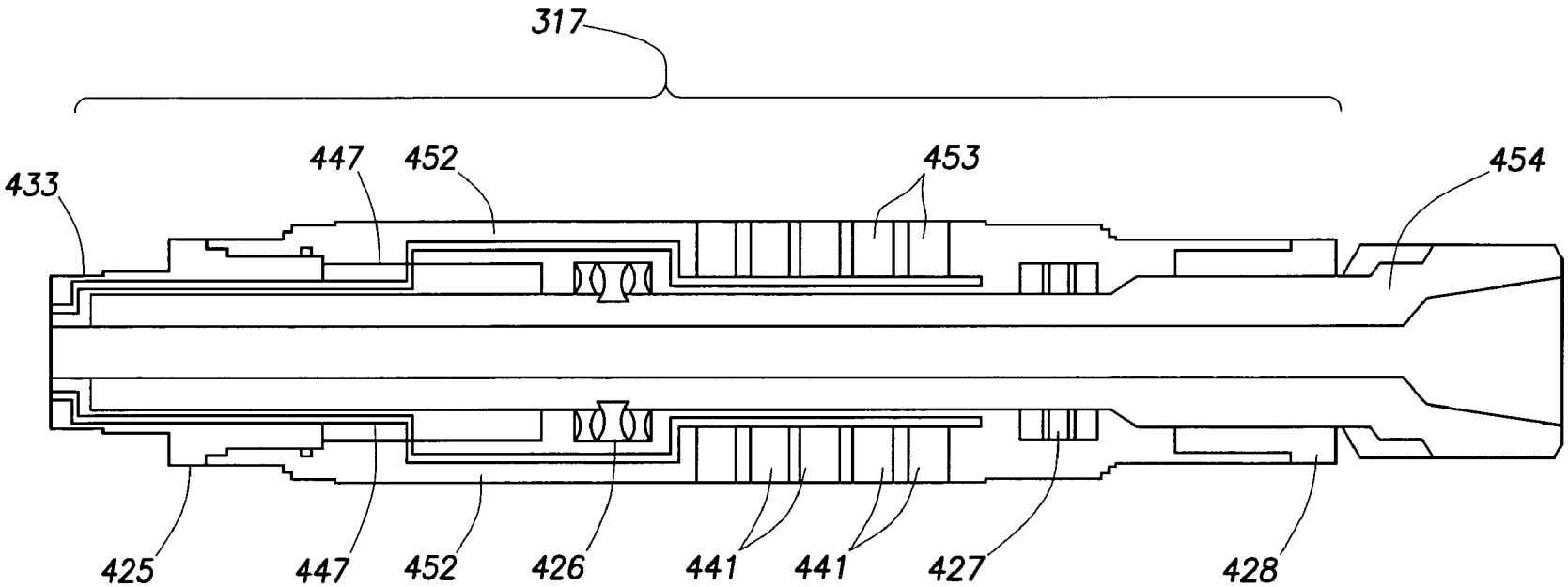
FIG. 6 shows a cross-section of an RSS according to one embodiment of the invention.

Another view of the RSS 317 is shown in FIG. 6. The RSS 317 preferably includes a number of hydraulic pistons 453 located on stabilizer blade 452. An anti-rotation device, such as elastic blade or rollers (not shown) may also be incorporated.

The number of blades and/or their dimension can vary and depends on the degree of control required. The number of stabilizer blades preferably varies between a minimum of three blades and a maximum of five blades for control. As the number of blades increase, better positional control may be achieved. However, as this number increases, the complexity of the activation mechanism also increases. Preferably, up to five blades are used when the activation becomes to complex. However, where the dimensions are altered, the number, position and dimension of the blades may also be altered.

The pistons 453 are internal to each of the blades 452 and are activated by flow which is bypassed through the drilling tool along the hydraulic conduits 447. The pistons 453 extend and retract the pads 441 as desired. The control and sensing section detect the position of the non-rotating sleeve of the downhole tool as it moves through the wellbore. By selectively activating the pistons to extend and retract the pads as described herein, the downhole tool may be controlled to change the wellbore tendency and drill the wellbore along a desire path.

The bearings 425, 426, 427, 428 are preferably mud-lubricated bearings which couple the RSS 317 to the rotating shaft 454. Bearings 425, 428 are preferably radial bearings and bearings 426, 427 are preferably thrust bearings. As applied herein, the mud-lubricated radial and thrust bearings produce a design that eliminates the need for rotating oil and mud seals. A portion of the bypassed flow through conduits 447 is utilized for cooling and lubricating these bearings.

The central shaft 454 is preferably positioned within the RSS 317 and extends therefrom to the drill bit (302 in FIG. 3). The central shaft 454 allows for the torque and weight-on-bit to be transmitted from the collar through the shaft to the bit (302 in FIG. 3). The central shaft 454 also carries the radial and axial loads produced from the system.

In some other embodiments, the invention relates to a casing drilling system coupled with a point the bit RSS. Again, the casing string is used to rotate the drill bit and to line the wellbore when desired.

Figure 7:
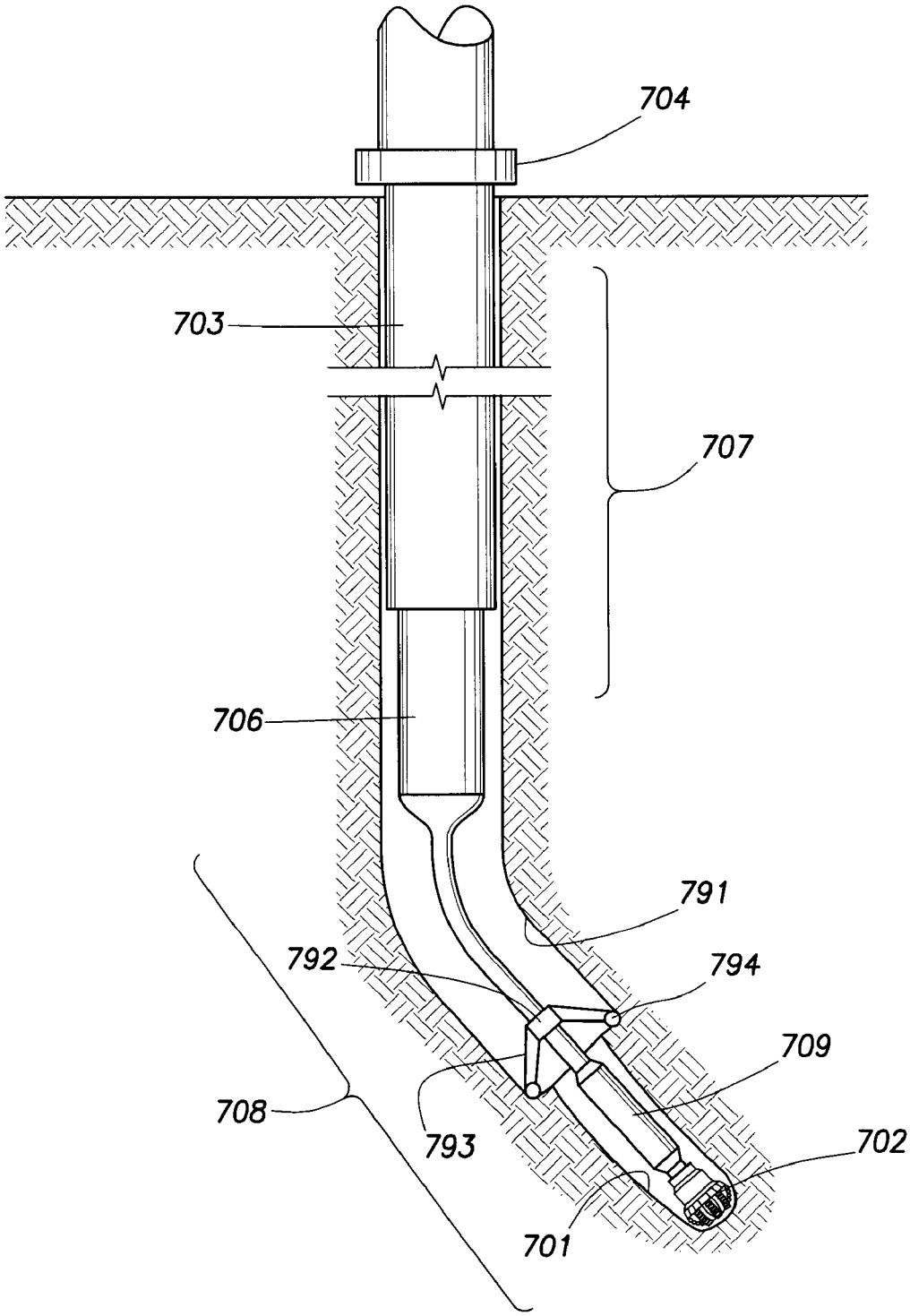
FIG. 7 shows a casing drilling application with a point the bit RSS according to one embodiment of the invention.

FIG. 7 shows a wellbore 791 that is being drilled by a rotary drill bit 702 that is connected to the lower end of a casing string 703 that is being used as a drill string. The casing string 703 extends upwardly to the surface where it is driven by a rotary table 704 or preferably top-drive of a typical drilling rig (not shown). The casing string 703 may have one or more drill collars 706 connected therein for the purpose of applying weight to the drill bit 702.

The drill bit 702 drills a pilot hole 701. Because the drill bit must fit inside the casing string 703, the pilot hole is not large enough for the casing string 703 to pass through it. The BHA also includes an underreamer 792 that enlarges the size of the wellboe 791. The underreamer 792 includes arms 793 with cutters 794 disposed at their ends. The arms 793 may be positioned in an extended position, as shown, to enlarge the wellbore 791 while drilling, or the arms 793 may be positioned in a retracted position (not shown) so that the underreamer 792 may pass through the casing string 703.

The well bore 701 is shown as having a vertical or substantially vertical upper portion 707 and a curved lower portion 708. The deviation of the well bore 701 is made possible by rotary steerable drilling tool 709.

Figure 8:
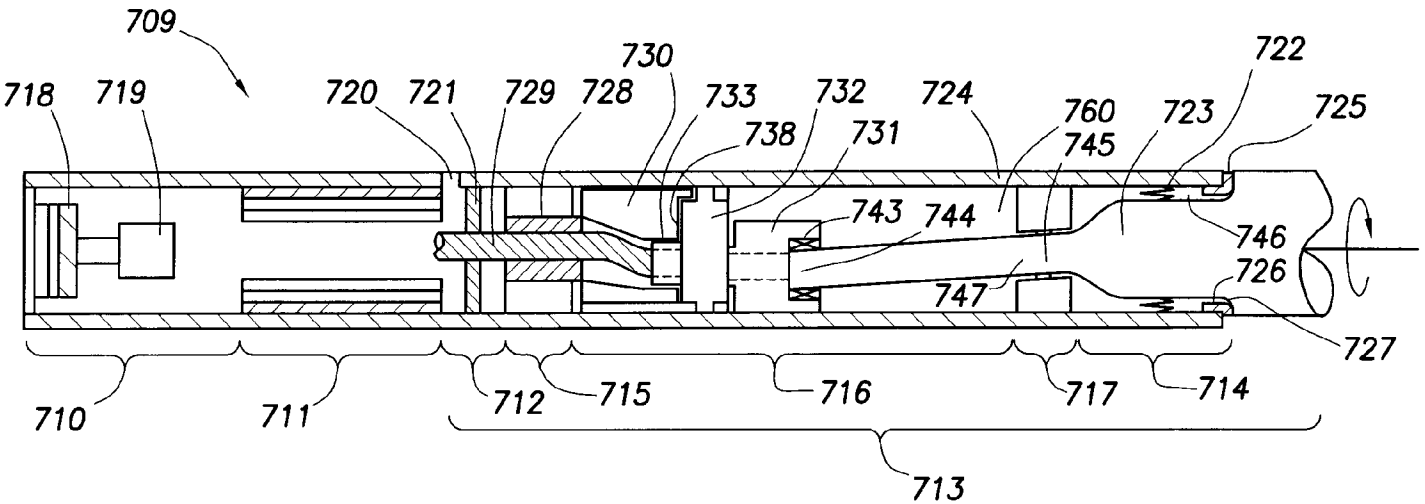
FIG. 8 shows a point the bit RSS according to one embodiment of the invention.

FIG. 8 shows the rotary steerable drilling tool 709 of FIG. 7 in greater detail. The rotary steerable drilling tool 709 includes at least three main sections: a power generation section 710, an electronics and sensor section 711 and a steering section 713.

The power generation section 710 comprises a turbine 718 which drives an alternator 719 to produce electric energy. The turbine 718 and alternator 719 preferably extract mechanical power from the drilling fluid and convert it to electrical power. The turbine preferably is driven by the drilling fluid which travels through the interior of the tool collar 724 down to the drill bit (702 in FIG. 7).

The electronics and sensor section 711 includes directional sensors (magnetometers, accelerometers, and/or gyroscopes, not shown separately) to provide directional control and formation evaluation, among others. The electronics and sensor section 711 may also provide the electronics that are needed to operate the tool 709.

The steering section 713 includes a pressure compensation section 712, an exterior sealing section 714, a variable bit shaft angulating mechanism 716, a motor assembly 715 used to orient the bit shaft 723 in a desired direction, and the torque transmitting coupling system 717. Preferably, the steering section 713 maintains the bit shaft 723 in a geostationary orientation as the collar 724 rotates.

The pressure compensation section 712 comprises at least one conduit 720 opened in the tool collar 724 so that ambient pressure outside of the tool collar can be communicated to the chamber 760 that includes the steering section 713 through a piston 721. The piston 721 equalizes the pressure inside the steering section 713 with the pressure of the drilling fluid that surrounds the tool collar 724.

The exterior sealing section 714 protects the interior of the tool collar 724 from the drilling mud. This section 714 maintains a seal between the oil inside of the steering section 713 and external drilling fluid by providing, at the lower end of the tool collar 724, a bellows seal 722 between the bit shaft 723 and the tool collar 724. The bellows 722 may allow the bit shaft 723 to freely angulate so that the bit (702 in FIG. 7) can be oriented as needed. In order to make the bellows 722 out of more flexible material, the steering section 713 is compensated to the exterior drilling fluid by the pressure compensation section 712 described above.

Figure 1:
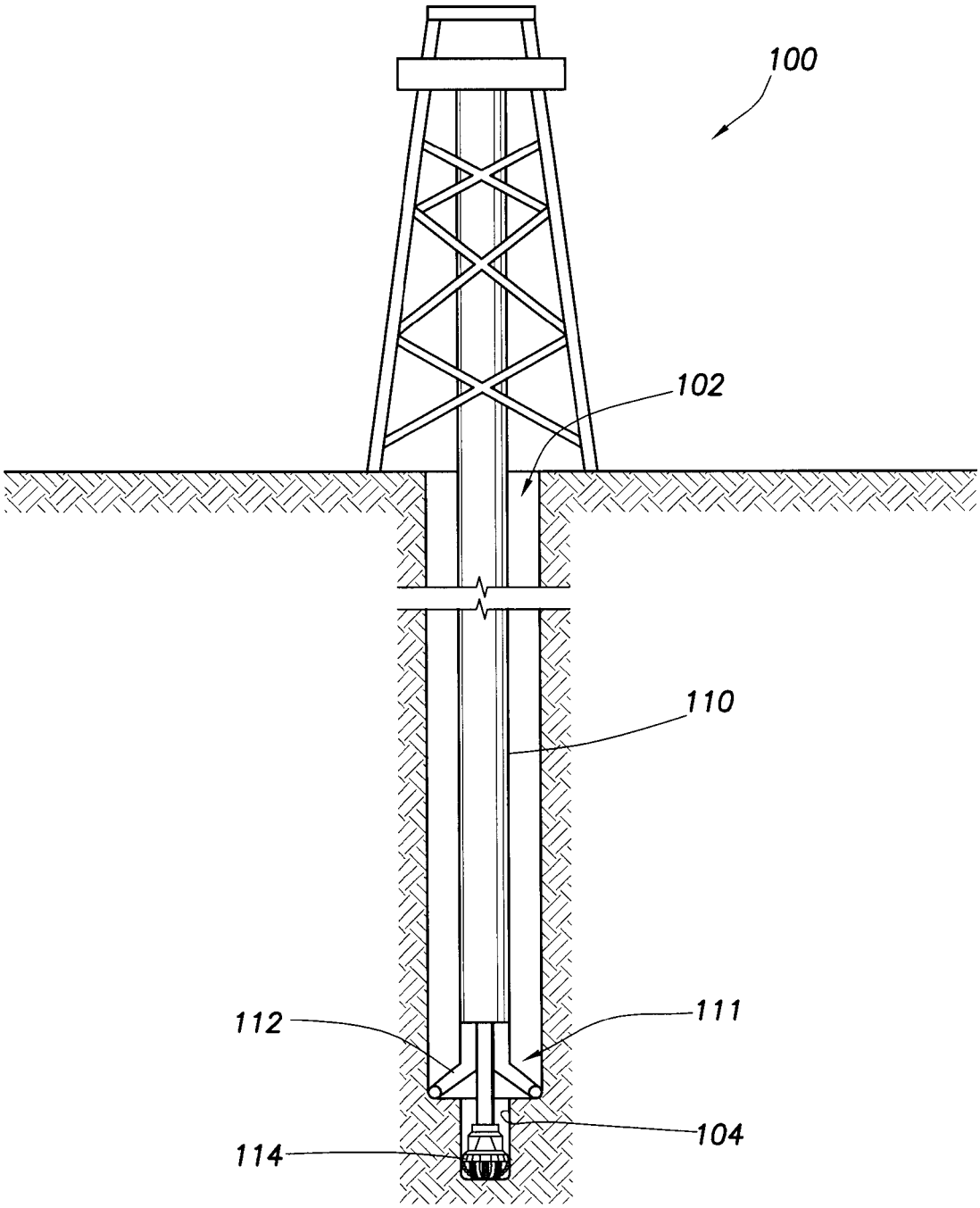
FIG. 1 (PRIOR ART)
FIG. 1 shows a prior art casing drilling operation.
Figure 2A:
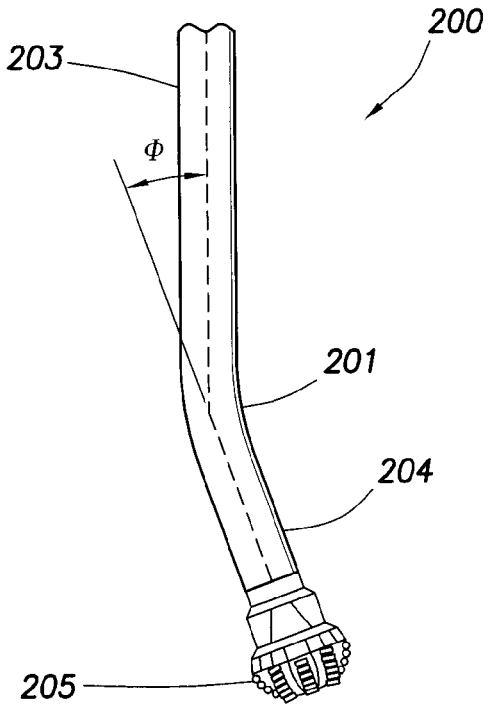
FIG.2A (PRIOR ART)
FIG. 2A shows a prior art bent sub drilling system.
Figure 2B:
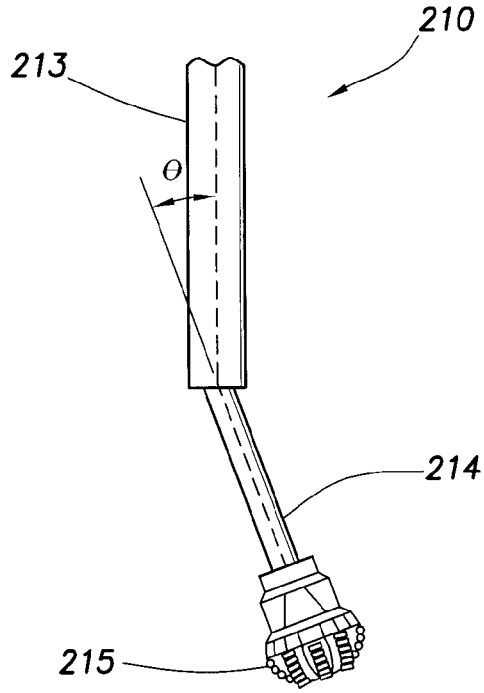
FIG.2B (PRIOR ART)
FIG. 2B shows a prior art point the bit RSS.
Figure 2C:
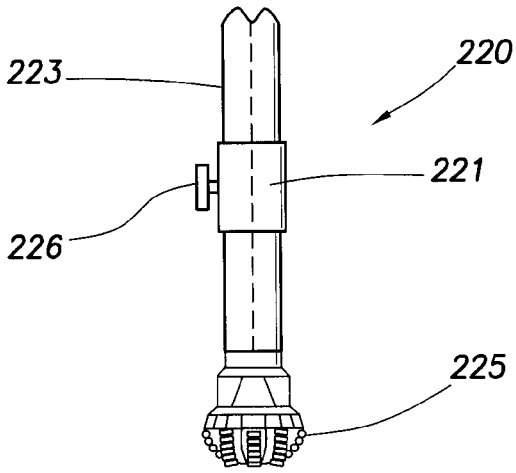
FIG.2C (PRIOR ART)
FIG. 2C shows a prior art push the bit RSS.

A bellows protector ring 725 may also be provided to closes a gap 746 between the bit shaft 723 and the lower end of the tool collar 724. As can be seen in FIG. 2, the bit shaft 723 is preferably conformed to a concave spherical surface 726 at the portion where the tool collar 724 ends. This surface 726 mates with a matching convex surface 727 on the bellows protector ring 725. Both surfaces 726, 727 have a center point that is coincident with the center of the torque transmitting coupling 747. As a result, a spherical interface gap 746 is formed that is maintained as the bit shaft 723 angulates. The size of this gap 746 is controlled such that the largest particle of debris that can enter the interface is smaller than the gap between the bellows 722 and bit shaft 723, thereby protecting the bellows 722 from puncture or damage.

The oil in the steering section 713 may be pressure compensated to the annular drilling fluid. As a result, the differential pressure may be minimized across the bellows 722. This allows the bellows 722 to be made from a thinner material, making it more flexible and minimizing the alternative stresses resulting from the bending during operation to increase the life of the bellows 722.

The motor assembly 715 operates the variable shaft angulating mechanism 716 which orientates the drill bit shaft 723. The variable bit shaft angulating mechanism 716 comprises the angular motor, an offset mandrel 730, a variable offset coupling 731, and a coupling mechanism 732. The motor assembly 715 is an annular motor that has a tubular rotor 728. Its annular configuration permits all of the steering section 713 components to have larger diameters, and larger load capacities than otherwise possible. The use of an annular motor also increases the torque output and improves cooling as compared with other types of motors. The motor may further be provided with a planetary gearbox and resolver (not shown), preferably with annular designs.

The tubular rotor 728 provides a path for the drilling fluid to flow along the axis of the tool 709 until it reaches the variable bit shaft angulating mechanism 716. Preferably, the drilling fluid flows through a tube 729 that starts at the upper end of the annular motor assembly 715. The tube 729 goes through the annular motor 715 and bends at the variable bit shaft angulating mechanism 716 reaching the drill bit shaft 723 where the drilling fluid is ejected into the drill bit (702 in FIG. 7). The presence of the tube 729 avoids the use of dynamic seals to improve reliability.

Alternate embodiments may not include the tube. The drilling fluid enters the upper end of the annular motor assembly 715, passes through the tubular rotor shaft, passes the variable shaft angle mechanism 716 and reaches the tubular drill bit shaft 723 where the drilling fluid is ejected into the drill bit (702 in FIG. 7). This embodiment requires two rotating seals; one where the mud enters the variable shift angle mechanism at the tubular rotor shaft and the other where the mud leaves the tubular rotor shaft. In this embodiment, the fluid is permitted to flow through the tool.

Angular positioning of the bit relative to the tubular tool collar is performed by the variable bit shaft angulating mechanism 716 shown generally in FIG. 8. The variation in the angular position of the bit is obtained by changing the location of the bit shaft's upper end 744 around the corresponding cross section of the tool collar 724, while keeping a point of the bit shaft 745, close to the lower end of the tool collar 724, fixed.

The bit shaft upper end 744 is attached to the lower end of the variable offset coupling 731. Therefore, any offset of the variable offset coupling 731 will be transferred to the bit. Preferably, the attachment is made through a bearing system 743 that allows it to rotate in the opposite direction with respect to the rotation of the variable offset coupling 731. The offset mandrel 730 is driven by the steering motor to maintain tool-face while drilling, and has an offset bore 733 on its right end.

The torque transmitting coupling system 717 transfers torque from the tool collar 724 to the drill bit shaft 723 and allows the drill bit shaft 723 to be aimed in any desired direction. In other words, the torque transmitting coupling system 717 transfers loads, rotation and/or torque from, for example, the tool collar 724 to the bit shaft 723.

Figure 9:
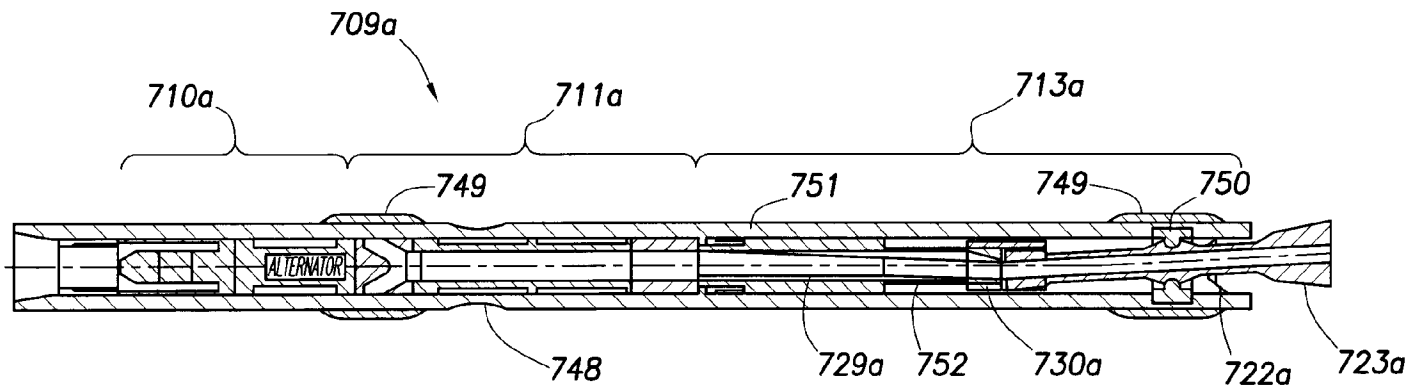
FIG. 9 shows a point the bit RSS according to one embodiment of the invention.

FIG. 9 shows an alternate embodiment of the rotary steerable drilling tool 709*a* without the variable bit shaft angulating mechanism (716 in FIG. 8). The tool 709*a* of FIG. 9 comprises a power generation section 710*a*, an electronics and sensor section 711*a*, a steering section 713*a*, a bit shaft 723*a*, an offset mandrel 730*a*, a flexible tube 729*a*, a telemetry section 748, bellows 722*a* and a stabilizer 749. The steering section 713*a* includes a motor and gear train 751, a geo-stationary shaft 752 and a universal joint 750.

In this embodiment, the bellows 722*a* are preferably made of a flexible metal and allows for relative motion between the bit shaft 723*a* and the collar (724 in FIG. 8) as the bit shaft 723*a* angulates through a universal joint 750. The tube 729*a* is preferably flexible and conducts mud through the motor assembly (715 in FIG. 8), bends where it passes through the other components, and finally attaches to the inside of the bit shaft 723*a*. The preferred embodiment incorporates a flexible tube 729*a* in the annular design. Alternatively, a rigid design may be used together with additional rotating seals, typically at the location where the mud would enter and another at the location where the mud would leave the components at the motor rotor, between the offset mandrel 730*a* and the bit shaft 723*a*. Preferably, the tube 729*a* is attached to the up-hole end of the steering section 713*a* and to the inside of the bit shaft 723*a*, at the lower end. The tube 729*a* may be unsupported, or may use a support bearing to control the bending of the tube. The tube may be made of a high strength and/or low elastic modulus material, such as high strength titanium alloy.

Figure 10:
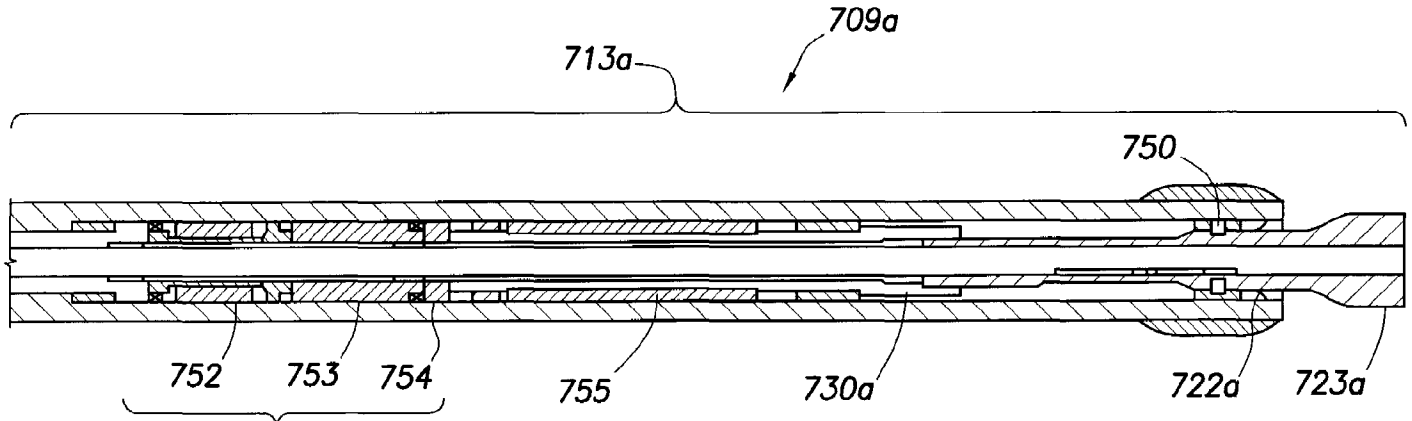
FIG. 10 shows a point the bit RSS according to one embodiment of the invention.

FIG. 10 shows a portion of the rotary steerable tool 709*a* of FIG. 9 and depicts the steering section 713*a* in greater detail. The steering section 713*a* includes a motor 752, an annular planetary gear train 753 and a resolver 754. The tool further includes a bit shaft 723*a*, an offsetting mandrel 730*a* and an eccentric balancing weight 755.

Figure 11:
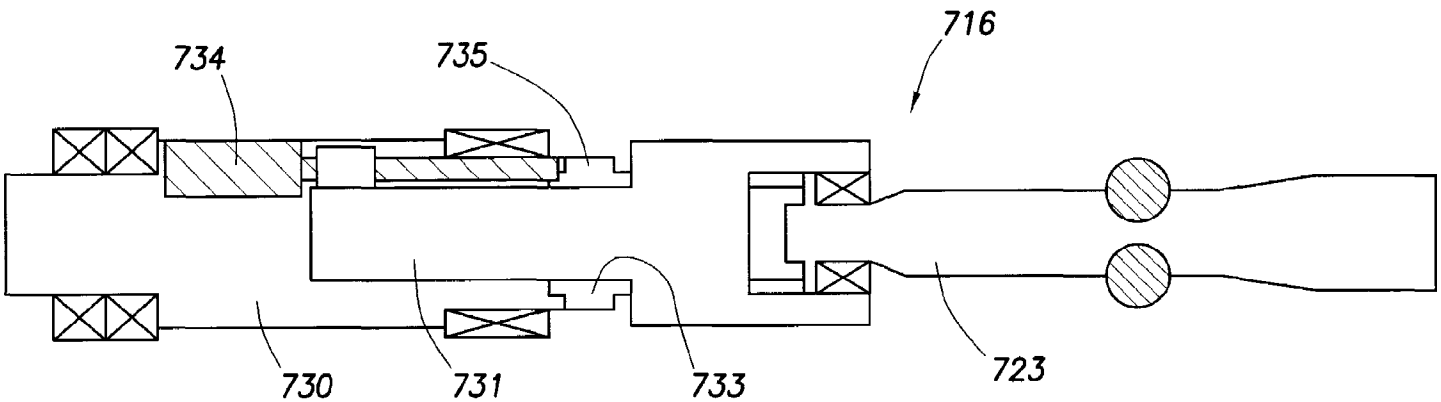
FIG. 11 shows a point the bit RSS according to one embodiment of the invention.

Referring now to FIG. 11, a detailed view of the variable shaft angulating mechanism 716 of the rotary steerable drilling tool 709 of FIG. 8 is shown. The variable shaft angulating mechanism 716 depicted in FIG. 11 includes offset mandrel 730, a motor ball screw assembly 734, a locking ring 735 and the variable offset coupling 731 coupled to the bit shaft 723.

The variable offset coupling 731 is held in the offset bore in the offset mandrel 730, and in turn holds the bearings supporting the end of the bit shaft 723 in an offset bore on an end. The offset at the end of the bit shaft 723 results in a proportional offset of the bit. The offset mandrel 730 and the variable offset coupling 731 may be rotated with respect to one another such that the offsets cancel one another, resulting in no bit offset. Alternatively, the offset mandrel 730 and variable offset coupling 731 may be rotated with respect to one another such that the offsets combine to produce the maximum bit offset, or at an intermediate position that would result in an intermediate offset.

The offset mandrel 730 preferably positions the uphole end of the bit shaft 723. The offset mandrel 730 has a bore 733 on its downhole face that is offset with respect to the tool axis. The bore acts as the housing for a bearing that is mounted on the end of the bit shaft. When assembled, the offset bore preferably places the bit shaft at an angle with respect to the axis of the tool.

The motor assembly (715 in FIG. 8) rotates the offset mandrel 730 to position the bit offset as desired. The tool may use a closed loop control system to achieve control of the bit offset as desired. The position of the offset mandrel 730 with respect to gravity is measured continuously by means of a resolver that measures rotation of the offset mandrel 730 with respect to the collar and the accelerometers, magnetometers and/or gyroscopes that measure rotation speed and angular orientation of the collar. Alternatively, the measurement could be made with sensors mounted directly on the offset mandrel 730 itself.

The metal bellows (722 FIG. 8) provide a seal between the bit shaft 723 and the collar (724 in FIG. 8) and preferably bend to accommodate the relative motion between them as the bit shaft nutates. The bellows (722 in FIG. 8) maintain the seal between the oil inside the assembly and the mud outside the tool, and withstand differential pressure as well as full reversal bending as the tool rotates. Finally, the bellows (722 in FIG. 8) are protected from damage by large debris by a spherical interface that maintains a small gap through which the debris may enter.

The locking ring 735 may also be used to lock the offset mandrel 730 and the variable offset coupling 731 together rotationally as shown in FIG. 11. Preferably, the locking ring 735 rotates with the variable offset coupling 731. While changing angle, the motor/ball screw assembly 734, or another type of linear actuator, pushes the locking ring 735 forward such that it disengages the offset mandrel 730 and engages the bit shaft 723. At that point, rotation of the offset mandrel 730 by means of the steering motor (not shown) will rotate the offset mandrel 730 with respect to the variable offset cylinder, resulting in a change in the offset. When the desired offset is achieved, the locking ring 735 may be retracted, disengaging the variable offset cylinder from the bit shaft 723 and locking it to the offset mandrel 730 once more.

Figure 12:
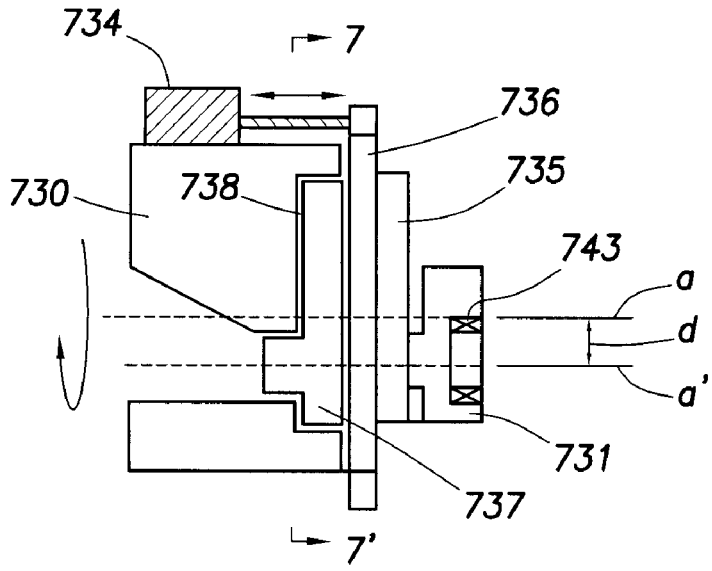
FIG. 12 shows a cross-section of an offset mandrel according to one embodiment of the invention.
Figure 13A:
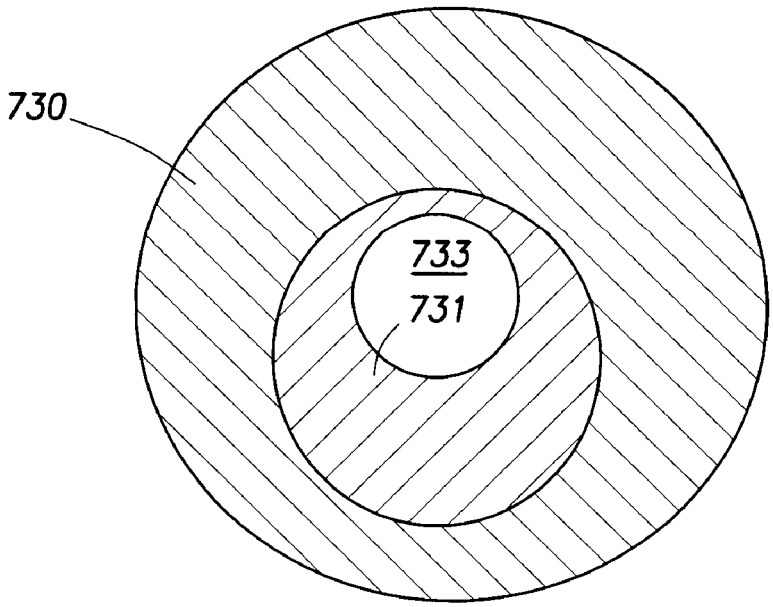
FIG. 13 shows a cross-section of an offset mandrel according to one embodiment of the invention.
FIG. 13B shows a cross-section of an offset mandrel according to one embodiment of the invention.
Figure 13B:
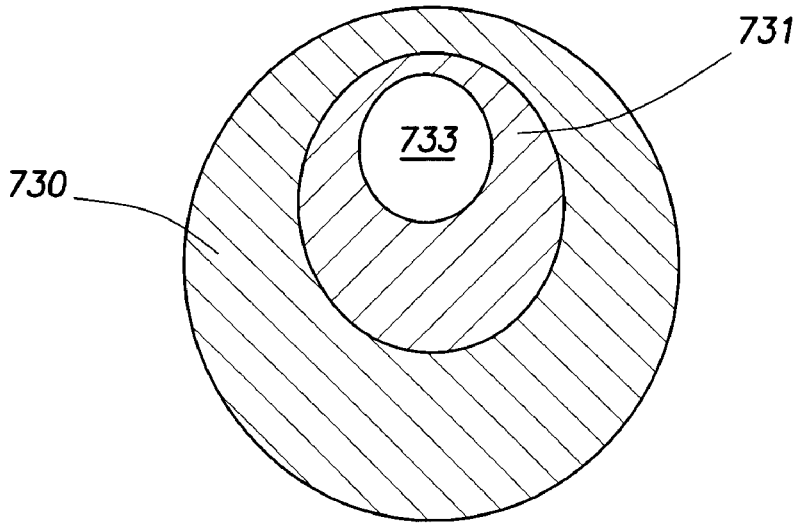

FIGS. 12, 13*a*, and 13*b* depict the offset mandrel 730 and the variable offset coupling 731. FIGS. 13*a* and 13*b* show a cross-section of the offset mandrel 730 taken along line 7–7' of FIG. 12. The offset mandrel 730 and the offset coupling 731 are attached in such a way that the distance (d) between their longitudinal axes (a–a') can be varied through the rotation of the offset mandrel 730 with respect to the variable offset coupling 731. The case when both axes are collinear corresponds to zero bit offset (FIG. 13*a*). Bit offset will occur when the distance (d) between the axes is different from zero (FIG. 13*b*).

The variable offset coupling 731 is uncoupleably attached to the offset mandrel 730 through a coupling mechanism. Once coupled, the variable offset coupling 731 rotates together with the offset mandrel 730.

In order to change the angle of the bit, the coupling mechanism disengages the variable offset coupling 731 from the offset mandrel. Once uncoupled, the offset mandrel 730 is free to rotate with respect to the variable offset coupling 731 in order to change the distance (d) of the axes (a–a') of the offset mandrel 730 and the variable offset coupling 731, therefore resulting in a change of the bit offset.

Referring to FIG. 11 again, the variable bit shaft angulating mechanism 716 comprises an offset mandrel 730 having a non-concentric bore 733, embedded in its lower end cross section. The upper end of the variable offset coupling 731 is held in the non-concentric bore.

Referring now to FIG. 12, a portion of the rotary steering tool of FIG. 8 depicting a coupling mechanism is shown. The coupling mechanism comprises a linear actuator 734 and a lock ring 735. The lock ring 735 couples the offset mandrel 730 and the variable offset coupling 731 in order that the offset mandrel's 730 rotation is transferred to the variable offset coupling 731. Coupling is accomplished by embedding the inner side 737 of the lock ring 735 in a recess 738 made in the lower end of the offset mandrel 730. In order to uncouple the variable offset coupling 731 from the offset mandrel 730, the actuator 734 pushes the lock ring 735 forward. The coupling of the offset mandrel 730 with the variable offset coupling 731 is accomplished by retracing the lock ring 735. Preferably, the actuator 734 acts on an outer ring 736 that extends from the edge of the lock ring 735. The actuator 734 may also be located within the offset mandrel 730 and acts on the interior surface of the lock ring 735. In this case, the actuator 734 would be embedded in the offset mandrel 730. Preferably, the actuator 734 is a linear actuator, such as for example, a motor/ball screw assembly.

In order to change the angle of the bit, the actuator 734 acts on the lock ring 735 such that the offset mandrel 730 is free to rotate with respect to the upper end of the variable offset coupling 731. Preferably, the variable offset coupling 737 is coupled to the bit shaft 723. The angular motor assembly (715 in FIG. 8) rotates the offset mandrel 730 until the desired bit orientation is achieved, then the variable offset coupling 731 may be again coupled to the offset mandrel 730. Preferably, during the rotation of the offset mandrel 730 the variable offset coupling 731 upper end is kept within the non-concentric bore 733 of the mandrel 730.

Referring to FIG. 8, the desired bit orientation is obtained by changing the position of upper end 744 of the bit shaft above and keeping one point 745 of the bit shaft fixed by the torque transmitting coupling system 717. The torque transmitting coupling system 717 is located at the fixed point of the drill bit shaft 745, opposite to the variable bit shaft angulating mechanism 716. The torque transmitting coupling system can include any type of torque transmitting coupling that transfers torque from the tool collar 724 to the drill bit shaft 723 even though both of them may not be coaxial.

Figure 14:
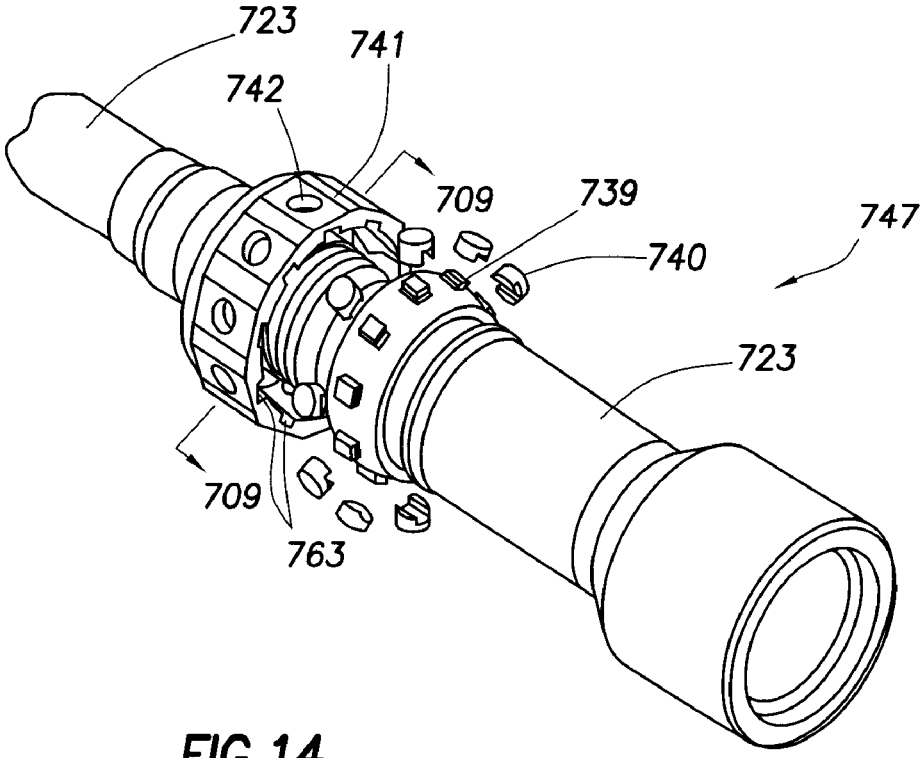
FIG. 14 shows an exploded view of an torque transmitting coupling according to one embodiment of the invention.

FIG. 14 shows an enlarged view of the torque transmitting coupling 747 of FIG. 8. It comprises protrusions 739 located on the drill bit shaft 723; each protrusion 739 covered by slotted cylinders 740. An exterior ring 741 including on its periphery holes 742 wherein the slotted cylinders 740 fit into the holes 742 in order to lock the protrusions 739. The corresponding slotted cylinders 740 are free to rotate within each corresponding hole 742 and also allow the protrusions 739 pivot back and forth.

The torque transmitting coupling 747 shown in FIG. 14 has a total of ten protrusions 739 surrounding the bit shaft 723. However, other embodiments of the invention can include more or fewer number of protrusions 739. Preferably, the protrusions 739 maintain surface contact throughout the universal joint as the joint angulates. While balls may be used, as in a standard universal joint, the torque transmission components of the preferred embodiment incorporate slotted cylinders 740 that engage the rectangular protrusions 739 on the drill bit shaft 723. The cylinders 740 preferably allow the protrusions 739 to pivot back and forth in the slots 763.

Figure 15:
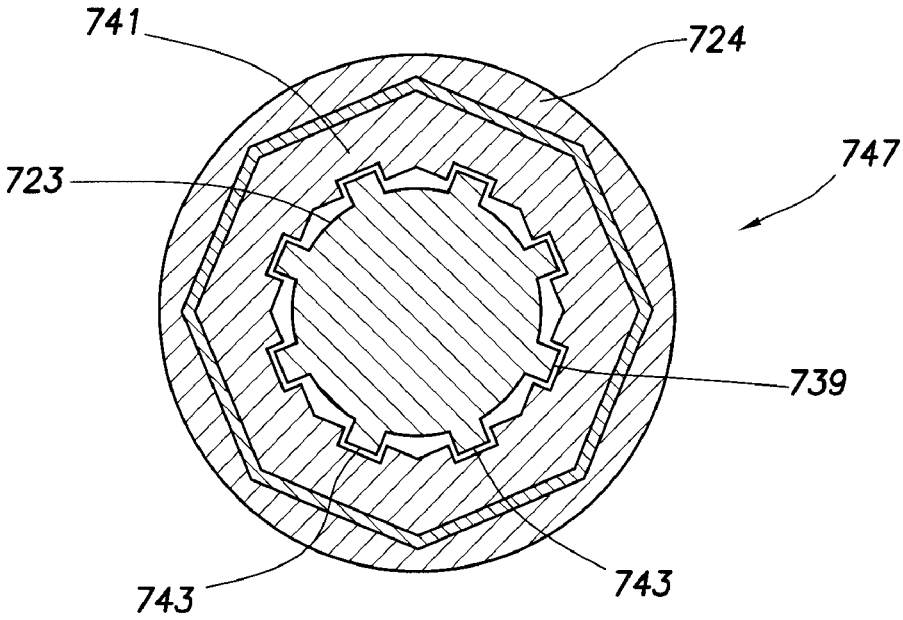
FIG. 15 shows cross-section of a torque transmitting coupling according to one embodiment of the invention.

The outer ring 741 of the torque transmitting coupling 747 is coupled to the inner surface of the tool collar 724 such that it rotates together with the tool collar 724 and transfers the corresponding torque to the drill bit shaft 723. With this configuration, torque is transferred from the protrusions 739 on the drill bit shaft 723 to the cylinders 740, then to the torque ring 741 and to the collar 724. As shown in FIGS. 14 and 15, torque transmission from the ring 741 to the collar 724 is preferably through a eight-sided polygon. Alternatively, other geometries and/or means of torque transfer known by those of skill in the art may be used.

FIG. 15 shows a cross section of the torque transmitting coupling 747. The cross sections of the exterior surface of the outer ring 741 and the interior surface of the tool collar 724, at least at the portion corresponding to the torque transmitting coupling section 747, are polygons such that they fit one into the other. Accordingly, each side of the polygon in the tool collar 724 mates with its counterpart side of the outer ring 741 polygon and transfers the tool collar 724 movement to the drill bit shaft 723.

Figure 16:
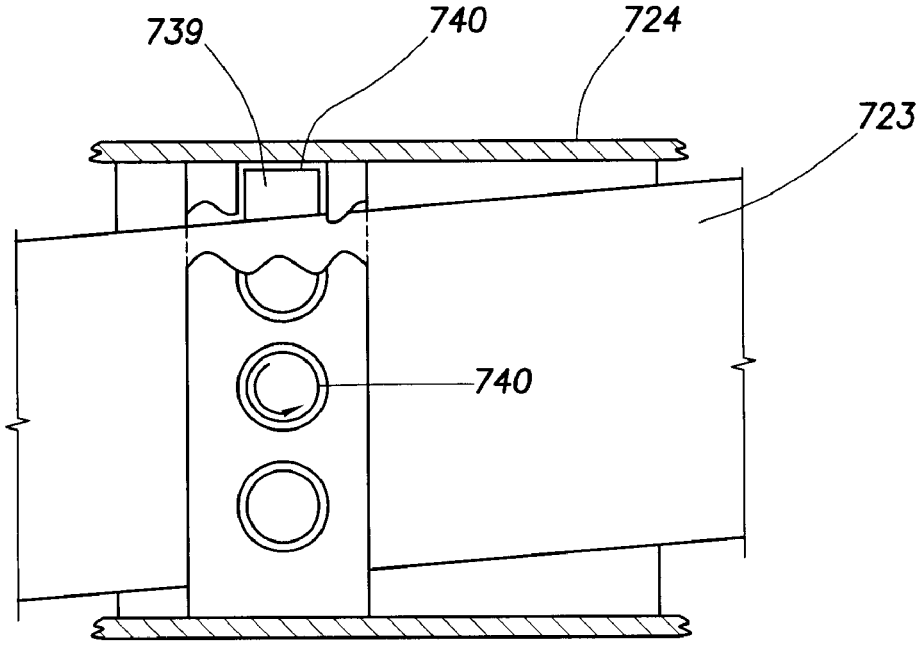
FIG. 16 shows a cross-section of a torque transmitting coupling according to one embodiment of the invention.

The protrusions 739 are free to pivot back and forth and the slotted cylinders 740 are free to rotate thereby enabling angulation of the bit shaft 723. As can be seen in FIG. 16, protrusions 739 located substantially on the same plane as the angulation plane of the bit shaft 723 will move, depending on their position on the bit shaft 723, back or forth, within the corresponding slotted cylinders 740. Protrusions 739 that lie substantially on the plane perpendicular to the angulation plane will have no relevant movement, but their corresponding slotted cylinders typically rotate in the direction of angulation.

Figure 17:
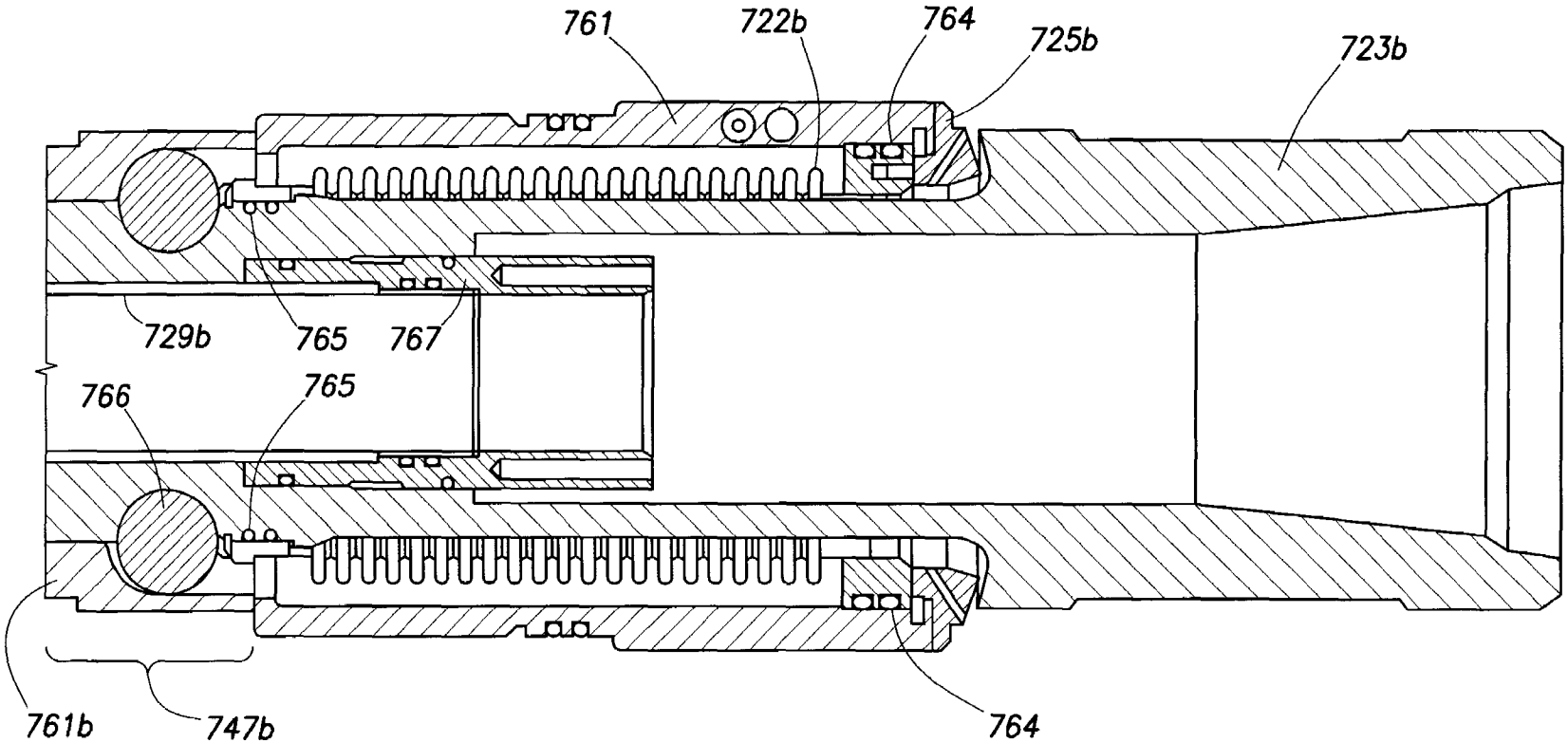
FIG. 17 shows a cross-section of a point the bit RSS in accordance with one embodiment of the invention.

Referring now to FIG. 17, a detailed view of a portion of a rotary steerable drilling tool 709*b* depicting the bellows 722*b* is shown. The bellows 722*b* are positioned on the external jam nut 761 which is threadably coupled to the collar (not shown). A bellows protector ring 725*b* is positioned between the bit shaft 723*b* and the external jam nut 761. The bellows 722*b* is secured along the bit shaft 723*b* by upper bellow ring 765, and along the jam nut 761 by lower bellow ring 764.

FIG. 17 also shows another embodiment of a torque transmitting coupling 747*b* including a torque transmitting ball 766 movably positionable between the bit shaft 723*b* and the torque ring 761*b*. The flexible tube 729*b* is shown within the bit shaft 723*b* and connected thereto by an internal jam nut 767.

In some embodiments, the invention relates to a casing drilling system coupled with a push the bit RSS, where the external parts of the BHA rotate with respect to the borehole. The counter rotating mechanism is located within the drill collar, and the drill bit is pushed in a desired direction by sequentially activated pads. The casing string is used to rotate the drill bit and to line the wellbore when desired.

Figure 18:
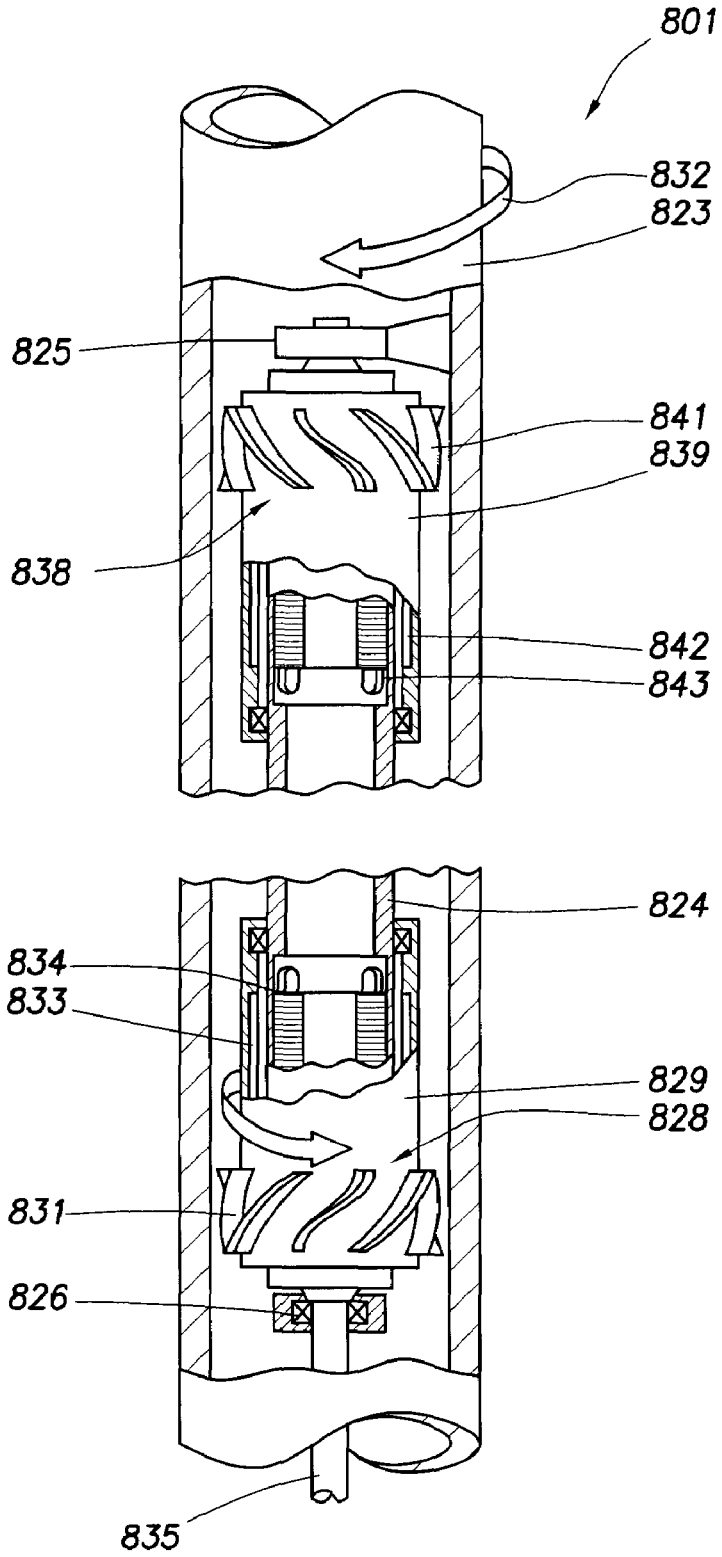
FIG. 18 shows a cutaway view of a control section according to one embodiment of the invention.

FIG. 18 shows a cutaway view of a control unit 801 for controlling a push the bit RSS in accordance with one embodiment of the invention. The control unit 801 is enclosed in a drill collar 823 that is connected to a casing string (not shown) that may be driven by a rotary table or preferably top drive at the surface (not shown). The drill collar 823 rotates in a clockwise direction (shown by arrow 832) with the casing string and the drill bit (not shown). An instrument carrier 824 is located inside the drill collar 823, and the instrument carrier 824 is mounted on bearings 825, 826 that enable the instrument carrier 824 to rotate relative to the drill collar 823.

The instrument carrier 824 will tend to rotate in the clockwise direction from the friction between it and the bearings 825, 826. In order to maintain the instrument carrier 824 in a geo-stationary position (i.e., in the same angular position relative to the borehole), the instrument carrier 824 includes an upper impeller 838 and a lower impeller 828 that convert energy from the mud flow into torque that is used to maintain the position of the instrument carrier 824.

The lower impeller 828 includes blades 831 that are coupled to a sleeve 829 that surrounds the lower end of the instrument carrier 824 and is mounted to the bearing 826. The blades 831 are positioned so that the mud flow will impart a counterclockwise torque on the instrument carrier 824.

The lower impeller 828 is coupled to the instrument carrier 824 by an electrical torquer-generator. The torquer-generator comprises a permanent magnets 833 in the sleeve 829 and an armature 834 in the instrument carrier 824. The magnets 833 and the armature 834 serve as a variable drive coupling that enable the amount of torque imparted to the instrument carrier 824 to be carefully controlled.

The upper impeller 838 includes blades 841 that are coupled to a sleeve 839 that surrounds the upper end of the instrument carrier 824 and is mounted to the bearing 825. The blades 841 are positioned so that the mud flow will impart a clockwise torque on the instrument carrier 824.

The upper impeller 838 is also coupled to the instrument carrier 824 by an electrical torquer-generator. The torquer-generator comprises a permanent magnets 842 in the sleeve 839 and an armature 843 in the instrument carrier 824. The magnets 842 and the armature 843 serve as a variable drive coupling that enable the amount of torque imparted to the instrument carrier 824 to be carefully controlled.

The torquer-generators associated with the upper impeller 838 and the lower impeller 828 may be controlled so that the net torque on the instrument carrier 824 is such that the instrument carrier 824 remains in a geo-stationary position. Thus, the drill collar 823 rotated with the casing string (not shown) and the drill bit (not shown), but the instrument carrier 824 counter rotates so that its angular position remains constant with respect to the borehole (not shown).

The instrument carrier 824 is coupled to a control shaft 835 at the bottom of the instrument carrier 824. The control shaft 835 controls the position of a valve that directs mud for controlling the extension of pads that contact the borehole wall.

Figure 19:
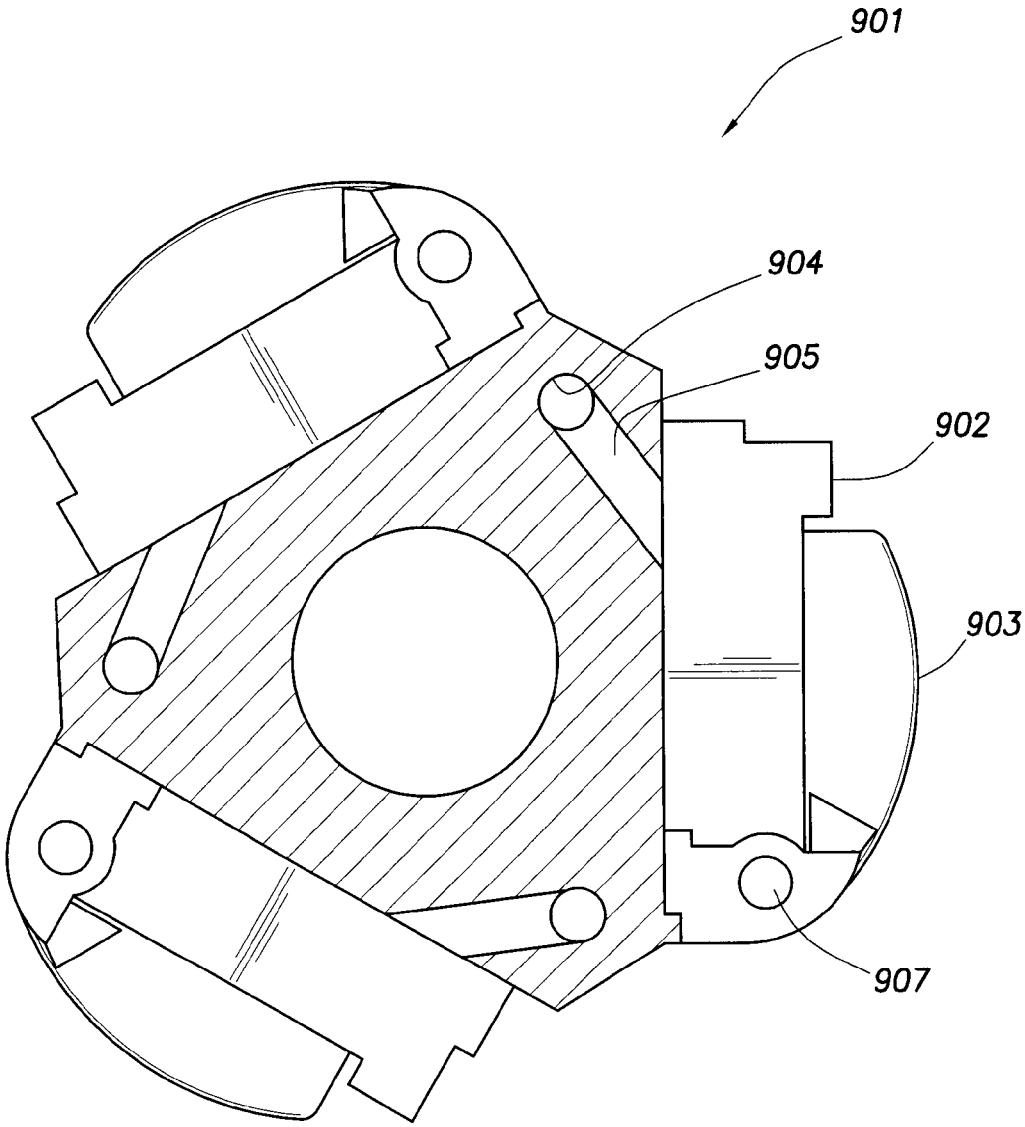
FIG. 19 shows a cross-section of a pad section in accordance with one embodiment of the invention.

FIG. 19 shows a cross-section of a rotating pad section 901 according to one embodiment of the invention. The rotating pad section 901 is adapted to be part of an RSS, wherein all of the external parts of the RSS rotate with respect to the borehole (not shown). The pad section 901 may be used in connection with a control section, such as the embodiment shown in FIG. 18.

The pad section shown in FIG. 19 includes three extendable pads spaced, preferably equally, around the pad section 901. Only one of these pads will be described, and it will be understood that the description applies to all. Further, the invention is not limited to a pad section with three pads. A pad section with more or less than three pads could be used without departing from the scope of the invention.

An selectively extendable pad 903 is mounted to a pad base 902 by a hinge 907. The pad base 902 is rigidly fixed to the pad section 901. The pad base 902 is connected to a mud passage 904 by a flow line 905. When mud pressure is applied to the mud passage 904, the pressure is transmitted through the flow line 905 to the pad base 902, where the pad 903 is actuated to an extended position.

The pad section 901 shown in FIG. 19 is adapted to be used in connection with a controller such as the one shown in FIG. 18. For example, the controller holds the control shaft (835 in FIG. 18) in a geo-stationary position. The control shaft (835 in FIG. 18) may be connected to a valve (not shown) that controls the flow of mud into the mud passages 904 of the pad section 901. Because the control shaft (835 in FIG. 18) is geo-stationary, mud pressure is only applied to one mud passage 904 at a time and only when the corresponding pad 903 is in a desired position for actuation. The control unit (801 in FIG. 18) remains in a geo-stationary position and operates the valve system (not shown) to modulate a fluid pressure supplied to the pad section 901 in synchronism with rotation of the casing string (e.g., 303 in FIG. 3) so that each of the at least one pads 902 is extended at the same rotational position relative to the borehole so as to bias the drill bit in the opposite direction. In this manner, the drill bit is "steered" in a desired direction.

Embodiments of the present may provide one or more of the following advantages. Advantageously, embodiments of the present invention enable directional drilling while using a casing string as a drill string. A deviated borehole may be drilled and lined with a casing at the same time.

Advantageously, embodiments of the present invention save considerable time because the borehole does not require casing to be inserted after drilling. Further, in unstable formations, embodiments of the present invention enable casing to be in place very shortly after an area of the borehole is drilled. This prevents unstable formations from collapsing into the borehole and delaying drilling efforts.

Advantageously, embodiments of the present invention enable casing drilling to be used with a rotary steerable system. A rotary steerable system is connected to a casing string that is rotated by a rotary table at the surface. The rotation of the entire casing string and BHA reduces the chances that any part of the drilling system will become caught or stuck in the borehole.

Advantageously, embodiments of the invention that relate to a push the bit system where all external parts of the system rotate with respect to the borehole enable casing drilling to be used while drilling a deviated borehole where there is a reduced change that any part of the BHA will become stuck during drilling.

Advantageously, a BHA in some embodiments of the invention may be easily and quickly removed from the borehole by pulling the drill bit and underreamer up through the casing string that was used as a drill string to drill the borehole.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A directional casing drilling system, comprising:

a casing swing for rotation of a drill bit;

a shaft coupled to the casing string;

a sleeve having pads hydraulically extensible therefrom, the sleeve positioned about at least a portion of the shaft;

a tube connecting the sleeve to the drill collar, the tube adapted to conduct drilling fluid therethrough; and a valve system adapted to operatively conduct at least a portion of the drilling fluid to the pads whereby the pads move between an extended position and a retracted position.

2. The directional casing drilling system according to claim 1, wherein the pads are selectively extensible by application of drilling fluid thereto.

3. The directional easing drilling system according to claim 1, further comprising at least one stabilizer blade located on the sleeve, each stabilizer blade having at least one pad therein.

4. The directional casing drilling system according to claim 3, wherein each pad comprises a piston.

5. The directional casing drilling system according to claim 4, wherein the at least one stabilizer blade comprises at least one first conduit adapted to conduct fluid from the sleeve to at least one pad contained therein.

6. A method of drilling a wellbore, comprising:

positioning a drilling tool connected to the end of a casing string in a wellbore, the drilling tool having a bit and a sleeve with extendable pads therein;

passing a fluid though the tool; and diverting at least a portion of the fluid to the sleeve for selective extension of the pads whereby the tool drills in a desired direction.

7. A rotary steerable casing drilling system, comprising:

a casing string for rotation of a drill bit;

a tool collar comprising an interior, an upper end and a lower end, the upper end of the tool collar operatively coupled to the casing string;

a bit shaft comprising an exterior surface, an upper end and a lower end, the bit shaft being supported within the tool collar for pivotal movement about a fixed position along the bit shaft;

a variable bit shaft angulating mechanism, located within the interior of the tool collar, comprising a motor, an offset mandrel having an upper end and a lower end, and a variable offset coupling, having an upper end and a lower end, the motor attached to the upper end of the offset mandrel and adapted to rotate the offset mandrel, the upper end of variable offset coupling being uncoupleably attached to an offset location of the lower end of the offset mandrel, and the upper end of the bit shaft being rotatably coupled to the variable offset coupling;

a torque transmitting coupling adapted to transmit torque from the tool collar to the bit shaft at the fixed position along the bit shaft; and a seal system adapted to seal between the lower end of the collar and the bit shaft.

8. The rotary steerable casing drilling system according to claim 7, further comprising a lock ring adapted to uncoupleably attach the variable offset coupling to the offset location of the offset mandrel.

9. The rotary steerable casing drilling system according to claim 8, further comprising an actuator adapted to uncouple the offset mandrel from the variable offset coupling.

10. The rotary steerable drilling casing system according to claim 9, wherein the lock ring comprises an outer ring on which the actuator acts.

11. The rotary steerable drilling casing system according to claim 10, wherein the actuator comprises a linear actuator.

12. The rotary steerable drilling casing system according to claim 11, wherein the linear actuator comprises a motor/ball screw assembly type.

13. The rotary steerable drilling casing system according to claim 12, wherein the bit shaft, at the fixed point, comprising a plurality of protrusions extending radially from the exterior surface of the bit shaft, wherein the torque transmitting coupling comprises:

a ring having an inner surface, a perimeter, and a plurality of perforations around the perimeter, wherein the ring surrounds the bit shaft and each protrusion is aligned with a perforation of the ring; and a plurality of cylinders comprising lower ends, each lower end having a slot, wherein the cylinders are located within the perforations of the ring and the protrusions enter the slots of the cylinders.

14. The rotary steerable drilling casing system according to claim 7, wherein the sealing system comprises:

a bellows seal located between the tool collar and the drill bit shaft; and a ring located between the tool collar and the drill bit shaft at the lower end of the tool collar, the ring having an upper end and a lower end.

15. The rotary steerable drilling system according to claim 7, wherein the motor is an annular motor.

16. The rotary steerable drilling system according to claim 15, further comprising a tube adapted to conduct drilling fluid from an upper end of the motor to the upper end of the drill bit shaft.

17. The rotary steerable system according to claim 7 wherein the variable bit shalt angulating mechanism is one of a fixed offset, mechanically fixed, selectively fixed, fixed at the surface and combinations thereof.

18. A rotary steerable casing drilling system, comprising:

a casing siring for rotation of a drill bit;

a control unit disposed in a drill collar, the control unit comprising an instrument carrier;

a first impeller coupled to the instrument carrier; and a second impeller coupled to the instrument carrier, a pad section having at least one pad hydraulically extensible therefrom; and a valve system operatively coupled to the control unit and adapted to selectively conduct at least a portion of a drilling fluid to the at least one pad whereby the at least one pad moves between an extended position and a refracted position, wherein the control unit remains in a geo-stationary position and operates the valve system to modulate a fluid pressure supplied to the pad section in synchronism with rotation of the casing string so that the at least one pad is extended at the same rotational position so as to bias the drill bit in a selected direction.

19. The rotary steerable casing drilling system according to claim 18, wherein at least one of the first impeller and the second impeller is coupled to the instrument carrier by a variable-drive coupling.

20. The rotary steerable casing drilling system according to claim 18, wherein the variable-drive coupling comprises an armature disposed in the instrument carrier and magnets disposed in a sleeve of the at least the first impeller and the second impeller.

21. The rotary steerable casing drilling system according to claim 18, wherein the control unit is coupled to the drill collar by a first bearing and a second bearing.

22. The rotary steerable casing drilling system according to claim 18, wherein the at least one pad comprises three pads that are equally spaced around a periphery of the pad section.

23. The rotary steerable casing drilling system of claim 18 further comprising a downhole power source selected from the group of motors, turbines and combinations thereof.

* * * * *